US012760492B2

(12) United States Patent
Eggle et al.

(10) Patent No.: US 12,760,492 B2
(45) Date of Patent: Oct. 13, 2026

(54) EXCAVATOR BUCKET

(71) Applicant: Liebherr-Hydraulikbagger GmbH, Munich (DE)

(72) Inventors: Florian Eggle, Memmingen (DE); Florian Strobel, Bad Wurzach (DE); Thomas Zitterbart, Dietenheim (DE)

(73) Assignee: LIEBHERR-HYDRAULIKBAGGER GMBH, Munich (DE)

( * ) Notice: Subject to any disclaimer, the term of this patent is extended or adjusted under 35 U.S.C. 154(b) by 263 days.

(21) Appl. No.: 18/491,660

(22) Filed: Oct. 20, 2023

(65) Prior Publication Data

US 2024/0133150 A1 Apr. 25, 2024
US 2024/0229412 A9 Jul. 11, 2024

(30) Foreign Application Priority Data

Oct. 21, 2022 (DE) ..... 10 2022 127 836.0

(51) Int. Cl.
*E02F 3/36* (2006.01)

(52) U.S. Cl.
CPC ..... *E02F 3/3686* (2013.01); *E02F 3/3609* (2013.01)

(58) Field of Classification Search
CPC ..... E02F 3/3686; E02F 3/3609; E02F 3/40
USPC ..... 37/468
See application file for complete search history.

(56) References Cited

U.S. PATENT DOCUMENTS 3,130,843 A * 4/1964 Kelly ..... E02F 3/40 37/444
4,373,852 A * 2/1983 Maurer ..... E02F 3/3631 414/723
5,692,852 A * 12/1997 Collins ..... E02F 3/3622 37/468
6,058,633 A * 5/2000 Barden ..... E02F 3/3672 37/468
6,662,681 B2 * 12/2003 Crane et al. ..... E02F 3/966 37/444

(Continued)

FOREIGN PATENT DOCUMENTS

CN 201330415 Y 10/2009
CN 206308727 U 7/2017

(Continued)

OTHER PUBLICATIONS

National Intellectual Property Administration of the People's Republic of China, Office Action and Search Report Issued in Application No. 202311369208.6, Jun. 11, 2026, 13 pages. (Submitted with Partial Translation).

*Primary Examiner* — Tara Mayo
(74) *Attorney, Agent, or Firm* — McCoy Russell LLP

(57) ABSTRACT

The disclosure relates to an excavator bucket. In one example, an excavator bucket includes a shell delimiting a bucket volume, and a retaining device connected to the shell, via which the excavator bucket is detachably connected to a quick coupling device of an implement. The retaining device includes a first bolt connected to the quick coupling device and bolt receptacles arranged in a collinear manner to each other for establishing a second connection to the quick coupling device. The retaining device includes a second bolt arranged on a side of the bolt receptacles opposite to the first bolt, wherein the bolts are arranged such that the second connection is established via the same bolt receptacles, both when using the first bolt and when using the second bolt.

14 Claims, 3 Drawing Sheets

(56) References Cited

U.S. PATENT DOCUMENTS

| | | | | |
|---|---|---|---|---|
| 6,964,122 | B2 | 11/2005 | Cunningham et al. | |
| 10,458,094 | B2 * | 10/2019 | Weaver | E02F 3/3636 |
| 2014/0373401 | A1 * | 12/2014 | Friedrich | E02F 3/365 37/468 |
| 2017/0275847 | A1 | 9/2017 | Marchetta et al. | |
| 2020/0123732 | A1 | 4/2020 | Hall et al. | |
| 2023/0313485 | A1 | 10/2023 | Stefano | |

FOREIGN PATENT DOCUMENTS

| | | | |
|---|---|---|---|
| CN | 113774973 | A | 12/2021 |
| DE | 102020110523 | A1 | 10/2021 |
| EP | 1239087 | A1 | 9/2002 |
| EP | 3951067 | A1 | 2/2022 |
| GB | 2551853 | A | 1/2018 |
| JP | H0612549 | U | 2/1994 |
| RU | 2236510 | C1 | 9/2004 |
| WO | 2006134245 | A1 | 12/2006 |

* cited by examiner

EXCAVATOR BUCKET

CROSS REFERENCE TO RELATED APPLICATION

The present application claims priority to German Patent Application No. 10 2022 127 836.0 filed on Oct. 21, 2022. The entire contents of the above-listed application are hereby incorporated by reference for all purposes.

TECHNICAL FIELD

The present disclosure relates to an excavator bucket, which can be used optionally as a front loader bucket or a backhoe bucket

BACKGROUND

Depending on the application, backhoe buckets, which pick up the excavated material towards the excavator, or front loader buckets, which pick up the excavated material towards the front or top, are used for earthmoving work using excavators. Due to the different requirements for backhoe bucket operation and front loader bucket operation—in particular, front loader buckets need to be mounted at a different angle relative to the excavator boom—separate front loader and backhoe buckets are often used, which are attached to the excavator boom depending on the application. Assembly and disassembly are usually carried out using mechanical quick couplers.

SUMMARY

Combi buckets are also known from the prior art that can be used both as backhoe buckets and as front loader buckets. To switch between the two operating modes, the excavator bucket must be rotated 180° (view from above). In order to enable mounting on the excavator boom, in particular on a quick coupler, in both positions, it is known to provide a plurality of bolt receptacles on the bearing block and to reposition the mounting bolt for the quick coupler. However, this is time-consuming and prevents a rapid switch between front loader bucket operation and backhoe bucket operation.

Against this background, the object of the present disclosure is to provide an excavator bucket that can be used both as a backhoe bucket and as a front loader bucket, and that allows quick and uncomplicated conversion with a quick coupler. Preferably, the kinematics should be optimized for both operating modes. According to the disclosure, this object may be achieved by an excavator bucket with the features of a shell delimiting a bucket volume, and a retaining device connected to the shell, via which the excavator bucket can be detachably connected to a quick coupling device of an implement, wherein the retaining device comprises a first bolt for establishing a first connection to the quick coupling device and bolt receptacles arranged in a collinear manner to each other for establishing a second connection to the quick coupling device, and wherein the retaining device may comprise a second bolt, by means of which the first connection to the quick coupling device can be established as an alternative to the first bolt, wherein the second bolt may be arranged on a side of the bolt receptacles opposite to the first bolt when viewed from above the retaining device, and wherein the bolts are arranged such that the second connection can be established via the same bolt receptacles, both when using the first bolt and when using the second bolt.

Advantageous embodiments of the disclosure result from the sub-claims and the following description.

Accordingly, an excavator bucket is proposed that can be used both as a front loader bucket and as a backhoe bucket. The excavator bucket comprises a shell, which delimits a bucket volume and a retaining device connected to the shell, via which the excavator bucket can be detachably connected to a quick coupling device of an implement. The quick coupling device can be a mechanical quick coupler of an excavator, in particular a hydraulic excavator.

The retaining device comprises a first bolt for establishing a first connection to the quick coupling device and bolt receptacles arranged in a collinear manner to each other for establishing a second connection to the quick coupling device. The term "bolt" is to be interpreted broadly and is not limited to a detachable bolt. For example, a retaining structure that is securely, i.e. non-releasably, attached to the retaining device and is at least partially cylindrical in shape can also be regarded as a bolt. The bolt can have a hollow profile or be designed as a solid bolt.

According to the disclosure, the retaining device comprises a second bolt, by means of which, alternatively to the first bolt, the first connection to the quick coupling device can be established. One of the two bolts (in the following—as an example and without limiting the generality—the first bolt) is used to establish the first connection in backhoe bucket operation and the other bolt (in the following the second bolt) is used to establish the first connection in front loader bucket operation. As two bolts are provided according to the disclosure, none of the bolts need to be removed or repositioned to switch between front loader bucket operation and backhoe bucket operation, which saves time and simplifies the conversion.

According to the disclosure, the second bolt is arranged on a side of the collinear bolt receptacles opposite the first bolt, as seen from above the retaining device. This takes into account the fact that the excavator bucket is rotated when switching between front loader bucket operation and backhoe bucket operation.

According to the disclosure, the two bolts are arranged such that the second connection can be established via the same bolt receptacles, both when using the first bolt and when using the second bolt. This means that there are not several bolt receptacles that are only used for front loader bucket operation and backhoe bucket operation, but the second connection is made via the same collinear bolt receptacles in both front loader bucket operation and backhoe bucket operation. in particular, exactly two collinear bolt receptacles are provided. This achieves a compact and uncomplicated construction of the retaining device. If the excavator bucket is used as a backhoe bucket, the quick coupling device is connected to the excavator bucket via the first bolt and the bolt receptacles. If the excavator bucket is used as a front loader bucket, the quick coupling device is connected to the excavator bucket via the first bolt and the same bolt receptacles.

The use of two mounting bolts, each of which is assigned to a type of use of the excavator bucket as a front loader bucket or backhoe bucket, means that there is no need for complicated or time-consuming repositioning when changing the operating mode. In addition, it is possible to arrange the bolts in such a way that optimum kinematics result for the respective operation as a front loader bucket or backhoe bucket. Furthermore, the same bolt receptacles can be used for connection in both operating modes, which again simplifies the changeover and enables a compact dimensioning of the retaining device.

The shell of the excavator bucket may have a known structure with two laterally arranged side walls and a curved rear wall, wherein the rear wall may form both the bottom and the rear wall and the top of the excavator bucket. The side walls can be oriented perpendicular to a pivot axis of the excavator bucket, i.e. parallel to each other. Of course, other geometries of the shell are also possible. The shell comprises an opening for filling and emptying the excavator bucket. The opening is in particular defined or delimited by a front edge, which is formed by the different walls of the shell. The front edge or opening may have a substantially rectangular shape overall, wherein other geometries are conceivable. The exact shape of the shell is not relevant for the function of the excavator bucket essential to the disclosure with regard to a conversion between front loader bucker operation and backhoe bucket operation and will therefore not be further discussed below.

In a possible embodiment, it is provided that the first bolt has the same distance from an imaginary connecting line extending centrally through the collinear bolt receptacles as the second bolt. This allows the connection means of the quick coupling device to be used to connect to the excavator bucket, regardless of whether the first or second bolt is used for the first connection.

In a further possible embodiment, it is provided that the retaining device does not have any further connecting elements besides the two bolts and the collinear bolt receptacles for connection to a quick coupling device. Therefore, no further bolts or bolt receptacles are provided.

In a further possible embodiment, it is provided that the retaining device comprises two fastening flanges projecting from the shell and extending parallel to each other, in which flanges the bolt receptacles are formed and the two bolts are fastened. The bolts are in particular arranged between the fastening flanges. Preferably, the fastening flanges are formed by sheets protruding vertically from the shell, which are in particular designed identically. The fastening flanges can be welded to the top of the shell of the excavator bucket. The shell can have further stiffening structures in the region of the fastening flanges, such as one or more torsion boxes.

In a further possible embodiment, it is provided that the fastening flanges comprise a first portion, which is arranged in the region of an opening of the excavator bucket defined by a front edge of the shell. The fastening flanges further comprise a second portion, which is arranged in the region of a rounded rear wall of the shell. In other words, the first portions of the fastening flanges are located between the front edge and the second portions. Preferably, the first bolt is arranged on the first portions, in particular between the first portions of the fastening flanges, while the second bolt is preferably arranged on the second portions, in particular between the second portions of the fastening flanges. The first bolt is therefore located closer to the front edge or bucket opening than the second bolt. Thus, the first bolt is suitable for connection as a backhoe bucket, while the second bolt can be used to establish the first connection when the backhoe bucket is used as a front loader bucket. The bolt receptacles can be designed in the first portions, in the second portions or in transition regions between the first and second portions.

In a further possible embodiment, it is provided that the fastening flanges in the first portion run substantially parallel to the sleeve, i.e. have a substantially constant height. This does not take into account any stiffening structures that may be provided, such as a torsion box, which may cause the top of the shell to bulge.

Alternatively or additionally, it can be provided that the fastening flanges in the second portion extend in a direction away from the shell and preferably taper in this direction. For example, this direction can run perpendicular or substantially perpendicular to the sleeve in the region of the second portion.

The second portions preferably form levers or fastening regions protruding or projecting rearwards and upwards from the shell, to which (in particular between which) the second bolt is fastened. This allows the special kinematics of the front loader bucket to be taken into account. In addition, this geometry results in a greater reach of the front loader bucket. In certain applications, such as undermining in canal construction, there is also improved handling.

In a further possible embodiment, it is provided that the longitudinal axes of the two bolts and an imaginary connecting line extending centrally through the collinear bolt receptacles do not lie in a common plane. This takes into account the special kinematics of the front loader bucket and combines the kinematics of the front loader bucket and the backhoe bucket in one system. The quick coupling device is thus attached to the excavator bucket at different angles to the shell, depending on whether it is used as a front loader bucket or a backhoe bucket. In particular, the quick coupling device can be attached substantially parallel to the top of the excavator bucket adjacent to the bucket opening when used as a backhoe bucket and at a certain (e.g. acute) angle to the top of the excavator bucket when used as a front loader bucket.

In a further possible embodiment, it is provided that the longitudinal axis of the first bolt and the previously mentioned imaginary connecting line span a first plane and the longitudinal axis of the second bolt and the imaginary connecting line span a second plane. The part of the second plane lying between the imaginary connecting line and the second bolt encloses an acute angle with the part of the first plane that is separated from the first bolt by the imaginary connecting line (i.e. is on the opposite side to the first bolt in relation to the imaginary connecting line) and lies "below the bolt" between the second bolt and the shell. It could also be said that the second plane has "swung out" upwards from the first plane by this angle. This angle is preferably between 10° and 60°. With larger angles, it is difficult to bring the quick coupling device or quick coupler into the correct locking position without an outer contour of the quick coupler colliding with the retaining device or a torsion box of the bucket. Smaller angles, on the other hand, do not usually produce the desired correction for use as a front loader bucket. Particularly preferably, the angle is between 20° and 40°.

In a further possible embodiment, it is provided that the two bolts run parallel to each other, wherein the second bolt preferably has a greater distance from the shell than the first bolt. This results in a greater reach of the front loader bucket and, for example, improved undermining in canal construction.

In a further possible embodiment, it is provided that two protective devices for mechanical protection of an energy circuit coupling half of the quick coupling device are arranged on the retaining device or on the shell in the region of the retaining device. The machine-side energy circuit coupling half can be one of two coupling parts of a quick coupling with hydraulic and/or electric connectors.

Since the excavator bucket usually does not have its own hydraulic actuator (but this is of course possible), it typically does not have its own energy circuit coupling half, so that the machine-side coupling part, which may be located on the quick coupling device, would be exposed. Therefore, a protective device such as a guard plate or a protective plate can be provided on the excavator bucket to cover the open energy circuit coupling half of the quick coupling device during operation and protect it from damage and/or dirt.

Since the excavator bucket according to the disclosure can be used both as a backhoe bucket and as a front loader bucket and the quick coupling device is arranged in a different orientation relative to the excavator bucket in each of the two operating modes, two separate protective devices are provided according to this embodiment in order to be able to optimally protect the energy circuit coupling half in both positions.

The protective devices preferably have a flat guard side facing away from the shell, wherein the guard sides of the two protective devices are at an angle to each other (i.e. not aligned parallel to each other). This is due to the fact that the quick coupling device is mounted at a different angle relative to the shell of the excavator bucket in front loader bucket operation than in backhoe bucket operation. The angle between the protective surfaces may correspond to the previously mentioned acute angle between the first and second planes.

The energy circuit coupling half may be designed according to the teachings of EP 1 239 087 A1 and may further comprise a centering device according to DE 10 2020 110 523 A1. In this case, the non-movable, i.e. not mounted via a spring device, (first) coupling part is preferably arranged on the quick coupling device and the protective devices are designed to cover this coupling part. Both of the above disclosures are hereby explicitly referred to.

The disclosure further relates to an implement, in particular a hydraulic excavator, having an excavator bucket according to the disclosure, wherein the implement preferably comprises a boom, on the end of which a quick coupling device is arranged for mounting the excavator bucket. An energy circuit coupling half as described above can be arranged on the quick coupling device.

In a possible embodiment, it is provided that the quick coupling device comprises first connecting elements for establishing a first connection, which can optionally be carried out by using the first or the second bolt of the excavator bucket. The quick coupling device further comprises second connecting elements for establishing a second connection to the collinear bolt receptacles of the excavator bucket.

Preferably, the first connecting elements comprise open bolt receptacles and/or the second connecting elements comprise one or more bolts that can be inserted into the collinear bolt receptacles of the excavator bucket. To connect the quick coupling device to the excavator bucket retaining device, the first connection is first established by inserting the first bolt (when used as a backhoe bucket) or the second bolt (when used as a front loader bucket) into the open bolt receptacles of the first connecting elements of the quick coupling device. This is done in particular by a corresponding movement of the quick coupling device relative to the stationary or parked excavator bucket. The quick coupling device is then pivoted about the previously established first connection or pivot connection until the second connecting elements of the quick coupling device overlap or are opposite the collinear bolt receptacles of the retaining device. Now a bolt connection is preferably made (=second connection) by pushing a bolt, preferably two bolts, through the bolt receptacles. Now the quick coupling device is securely locked to the excavator bucket.

The disclosure further relates to a method for converting the excavator bucket according to the disclosure between a backhoe bucket operation and a front loader bucket operation, wherein the method comprises the following steps:

First, the second connection between the second connecting elements of the quick coupling device and the bolt receptacles of the retaining device is released. This is achieved in particular by pulling one, in particular two, locking bolts out of the collinear bolt receptacles of the retaining device. For this purpose, the quick coupling device can have an actuator-driven bolt pulling device (wherein a manual pulling of the locking bolts is also conceivable).

The first connection between the first connecting elements of the quick coupling device and the first bolt (if the excavator bucket was previously used as a backhoe bucket) or the second pin (if the excavator bucket was previously used as a front loader bucket) of the retaining device is then released. This is achieved in particular by unhooking open bolt receptacles of the quick coupling device from the first or second bolt.

The excavator bucket is then rotated relative to the quick coupling device and/or the quick coupling device relative to the excavator bucket, so that subsequently, as viewed from the quick coupling device, the first and second bolts are interchanged.

The first connection is then re-established, but now with the other bolt, i.e. the first connection is established between the first connecting elements of the quick coupling device and the second pin (if the connection with the first pin was previously removed) or the first pin (if the connection with the second pin was previously removed) of the retaining device. This is preferably achieved by hooking the open bolt receptacles onto the corresponding bolt.

Finally, the second connection between the second connecting elements of the quick coupling device and the same bolt receptacles of the retaining device is established. For this purpose, the quick coupling device is preferably pivoted towards the bolt receptacles around the previously established first connection, so that the second connection can be established or the one or more locking bolt(s) can be inserted.

In a possible embodiment, it is provided that the change between backhoe bucket operation and front loader bucket operation is performed without disconnecting or reconnecting the first or second bolt and using the same collinear bolt receptacles.

BRIEF DESCRIPTION OF THE FIGURES

Further features, details and advantages of the disclosure result from the following exemplary embodiment explained with the help of the figures. In the figures.

DETAILED DESCRIPTION

Figure 1:
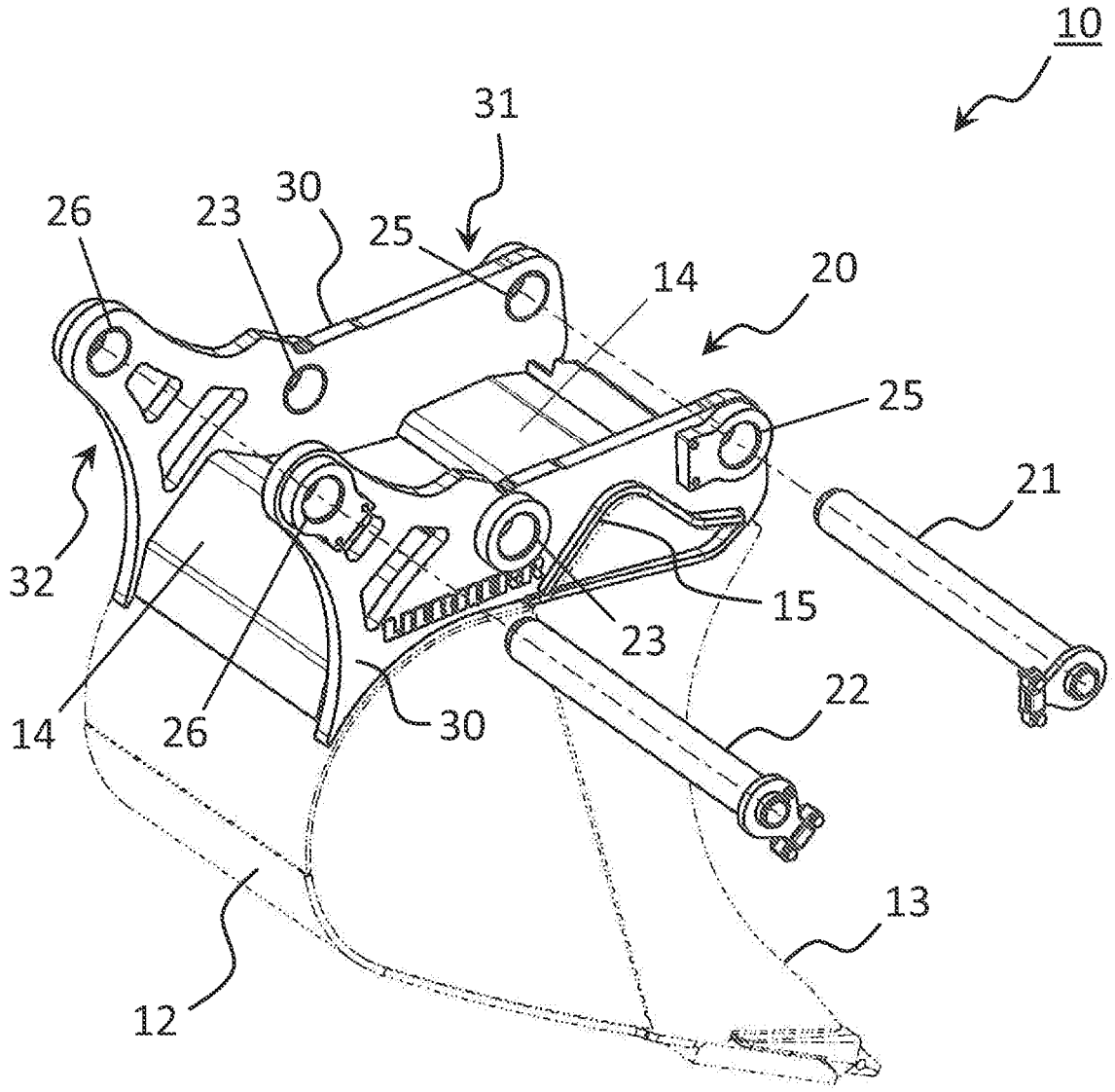
FIG. 1: shows a preferred exemplary embodiment of the excavator bucket according to the disclosure in a perspective view.

FIG. 1 shows a preferred exemplary embodiment of the excavator bucket 10 according to the disclosure in a perspective exploded view. The excavator bucket 10 according to the disclosure comprises a steel shell 12, which delimits an internal bucket volume and has an opening for filling and emptying the excavator bucket 10. In the exemplary embodiment shown here, the shell 12 comprises two laterally arranged side walls and a curved rear wall, wherein the latter forms both the bottom and the rear wall and top of the excavator bucket 10. The opening is defined or delimited by a front edge 13, which is formed by the different walls of the shell 12. The front edge 13 or opening may have a substantially rectangular shape.

In the upper region or on the upper side of the shell 12, the excavator bucket 10 according to the disclosure has a retaining device 20 that attaches the excavator bucket 10 to a quick coupler (=quick coupling device) of an implement such as, for example, an excavator. The retaining device 20 comprises two plate-shaped fastening flanges 30 extending perpendicular to the upper outer contour of the shell 12 and parallel to each other. The fastening flanges 30 each have a first portion 31 located adjacent to the front edge 13. The first portions 31 have a substantially constant height and have a bolt receptacle 25 in an end region facing the front edge 13, in which a first bolt 21 is accommodated.

The fastening flanges 30 each have a second portion 32 that, starting from the front edge 13, connects to the first portion 31 in the direction of the rear of the excavator bucket. The second portions 32 project obliquely rearwards/upwards from the shell 12 and taper to an end portion, each of which has a further bolt receptacle 26 formed therein. A second bolt 22 is accommodated in these bolt receptacles 26.

In the exploded view of FIG. 1, the bolts 21, 22 are shown outside the bolt receptacles 25, 26 to illustrate that in this exemplary embodiment the bolts 21, 22 can be stored in the bolt receptacles 25, 26 and are therefore in principle removable (although they do not need to be removed for conversion). Alternatively, the bolts 21, 22 could also be securely connected, in particular welded, to the fastening flanges 30.

Between the first and second bolts 21, 22, in the transition region between the first and second portions 31, 32, the fastening flanges 30 have central bolt receptacles 23. These central bolt receptacles 23 are arranged collinear to each other and receive at least one, preferably two, locking bolts of the quick coupler.

The retaining device 20 according to the disclosure allows the excavator bucket 10 to be used either as a backhoe bucket or as a front loader bucket and to be connected to the same quick coupler. For this purpose, either the first bolt 21 or the second bolt 22 is used together with the central bolt receptacles 23 to connect to the quick coupler, depending on the mode of operation (front loader bucket or backhoe bucket operation). The retaining device 20 therefore has two different positions for engaging the quick coupler. To change the excavator bucket 10 according to the disclosure between front loader bucket and backhoe bucket, no bolts 21, 22 on the excavator bucket 10 have to be repositioned.

When the excavator bucket 10 is used as a backhoe bucket, the quick coupler is connected to the first bolt 21 to form a first connection and to the central bolt receptacles 23 to form a second connection. On the other hand, if the excavator bucket 10 is used as a front loader bucket, the excavator bucket is provided rotated 180° relative to the quick coupler and the quick coupler is connected to the second bolt 21 to form the first connection and to the central bolt receptacles 23 to form the second connection. The first connection to the quick coupler is therefore established either via the first bolt 21 or the second bolt 22, depending on the mode of operation. The center bolt receptacles 23, on the other hand, are used to connect to the quick coupler in both cases.

The solution according to the disclosure makes it possible to combine the special kinematics of the backhoe bucket and the special kinematics of the front loader bucket in one system without having to make any compromises. For this purpose, the fastening flanges 30 have the characteristic shape shown in FIG. 1 with the second portions 32 projecting upwards towards the rear, at the end portions of which the second bolt 22 is arranged or fastened. On the one hand, this geometry extends the distance between the second bolt 22 and the shell 12, resulting in a greater reach in front loader bucket operation. For special work, such as undermining in canals, there is also improved working behavior.

Figure 2:
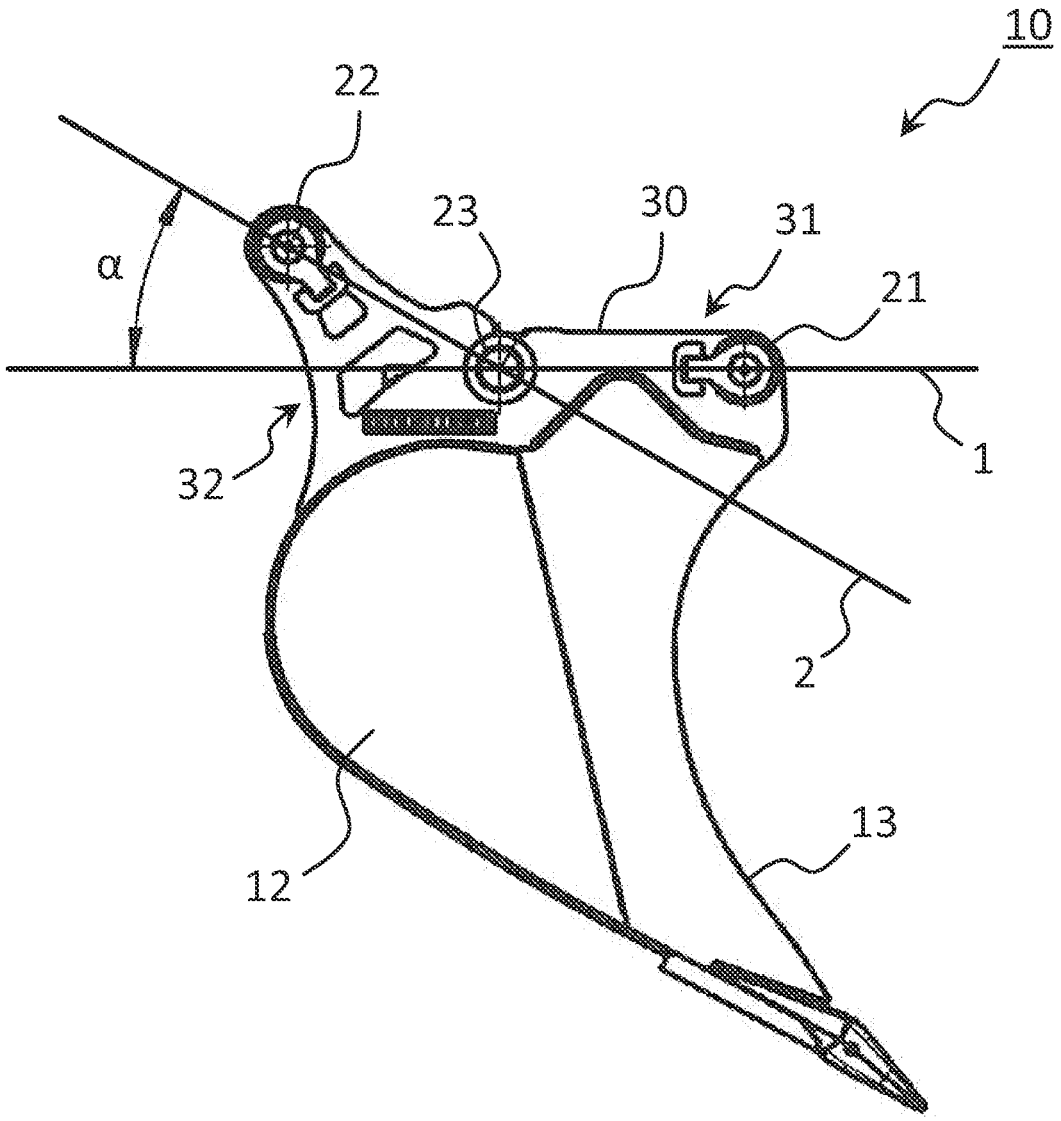
FIG. 2: shows an excavator bucket according to FIG. 1 in a side view.

On the other hand, this geometry takes into account the special requirements for the kinematics of the front loader bucket, which is attached to the quick coupler at a different angle. As can be seen in particular in the side view of the excavator bucket 10 of FIG. 2, the central axes or longitudinal axes of the first bolt 21 and the central bolt receptacles 23 (here the term "longitudinal axis" refers to an imaginary line running centrally through the bolt receptacles 23) lie in a common first plane 1 and the central axes or longitudinal axes of the second bolt 22 and the central bolt receptacles 23 lie in a common second plane 2. The two planes 1, 2 are not parallel to each other, but the second plane 2 is "swung out" from the first plane 1 by an angle $\alpha$ upwards. More specifically, the portions of the first and second planes 1, 2 in FIG. 2, each lying to the left of the imaginary line through the central bolt receptacles 23, enclose an acute angle $\alpha$ with each other.

The longitudinal axes of the two bolts 21, 22 and the imaginary line through the central bolt receptacles 23 are therefore not in a common plane. This allows the excavator bucket 10 to be connected to the quick coupler at an angle optimized for front loader bucket operation. The special shape of the fastening flanges 30 or the elevated position of the second bolt 22, which has a greater distance from the shell 12 than the first bolt 21, represents an angle correction for front loader bucket operation. The angle $\alpha$ can therefore also be called the correction angle. The retaining device 20 thus combines the advantages of both bucket types.

Figure 3A:
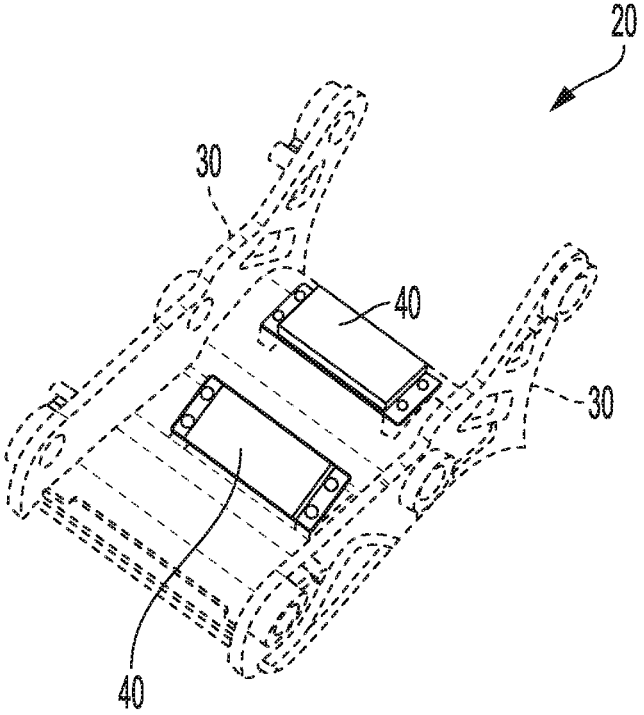
FIGS. 3*a-b*: show the protective devices and the arrangement thereof in the retaining device in a perspective view and a side view.
Figure 3B:
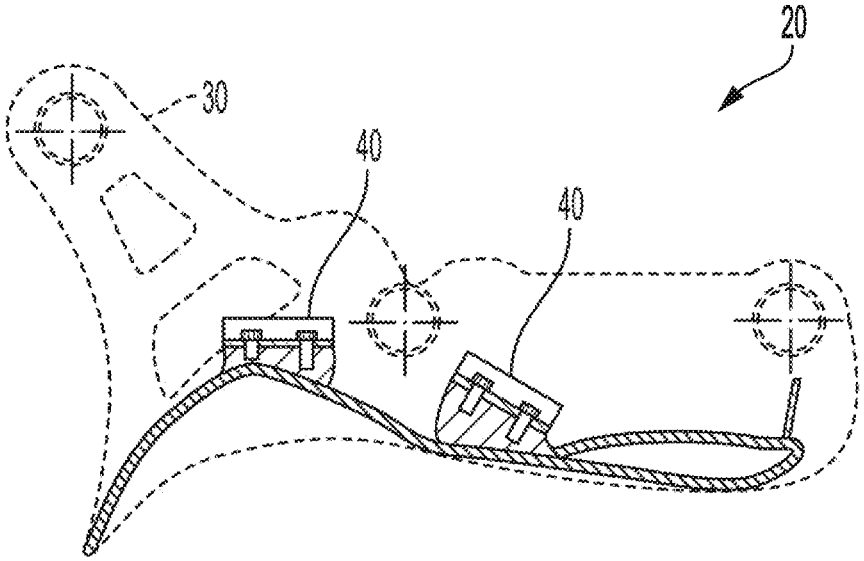

This geometry provides a particular advantage. As shown in FIGS. 3*a* and 3*b*, which respectively show a perspective and a side view of the retaining device 20, two protective devices 40 or guard plates 40 may be mounted on the shell 12 in the region between the fastening flanges 30. These protective devices 40 have a flat guard side that covers an energy circuit coupling half of the quick coupler when it is mounted on the excavator bucket 10. Such energy circuit couplings are known, for example, from EP 1 239 087 A1 or DE 10 2020 110 523 A1 and automatically establish electrical and/or hydraulic connections during mechanical coupling of the attachment tool. In the event that the excavator bucket 10 according to the disclosure does not have an actuator and such an energy circuit coupling half is arranged on the quick coupler, the free coupling half can be covered by one of the guard plates 40 and thereby protected. Since there are two possible mounting positions for the quick coupler, two guard plates 40 are preferably provided, which are arranged at an angle to each other, which preferably corresponds to the correction angle $\alpha$ described above.

The energy circuit coupling half is also protected by the bolt 21, 22, which is not used for the connection, so that the bolt 21, 22 has an additional mechanical protective function in backhoe bucket and front loader bucket operation. As can be seen in FIG. 1, the excavator bucket 10 may have one or more stiffening structures in the form of a torsion box 14 on its upper side in the region of the retaining device 20, which improves the stability of the excavator bucket 10. In the exemplary embodiment shown here, two torsion boxes 14 are provided, wherein one torsion box 14 is arranged in the region of the first portion 31 and a second torsion box 14 is arranged in the region of the second portion 32 of the fastening flanges 30.

In the exemplary embodiment shown here, the front torsion box 14 is formed in the region of the first portion 31 by an additional bent sheet 15 that has been welded onto the shell 12. The fastening flanges 30 have a complementary contour on their underside that takes into account the "bulging" shape of the torsion box 14. In the rear torsion box 14, on the other hand, the upper sheet is arranged between the fastening flanges 30. Alternatively, both torsion boxes 14 could be formed like the front torsion box or like the rear torsion box 14. Other forms of stiffening structures are also conceivable.

LIST OF REFERENCE NUMERALS

1 First plane
2 Second plane
10 Excavator bucket
12 Shell
13 Front edge
14 Stiffening structure (torsion box)
15 Sheet
20 Retaining device
21 First bolt
22 Second bolt
23 Bolt receptacle
25 Bolt receptacle for the first bolt
26 Bolt receptacle for the second bolt
30 Fastening flange
31 First portion
32 Second portion
40 Protective device
α Correction angle

The invention claimed is:

1. Excavator bucket, which can be used both as a front loader bucket and as a backhoe bucket, comprising a shell delimiting a bucket volume, and a retaining device connected to the shell, via which the excavator bucket can be detachably connected to a quick coupling device of an implement, wherein the retaining device comprises a first bolt for establishing a first connection to the quick coupling device and bolt receptacles arranged in a collinear manner to each other for establishing a second connection to the quick coupling device, wherein the retaining device comprises a second bolt, by means of which the first connection to the quick coupling device can be established as an alternative to the first bolt, wherein the second bolt is arranged on a side of the bolt receptacles opposite to the first bolt when viewed from above the retaining device, wherein the bolts are arranged such that the second connection can be established via the same bolt receptacles, both when using the first bolt and when using the second bolt; and wherein a transition region between the first bolt and the second bolt comprises central bolt receptacles arranged collinear to one another, wherein locking bolts of the quick coupling device are received by the central bolt receptacles.

2. Excavator bucket according to claim 1, wherein the first bolt has the same distance from an imaginary connecting line extending centrally through the bolt receptacles as the second bolt.

3. Excavator bucket according to claim 2, wherein the retaining device does not have any further connecting elements besides the two bolts and the bolt receptacles for connection to a quick coupling device.

4. Excavator bucket according to claim 3, wherein the retaining device comprises two fastening flanges projecting from the shell and extending parallel to each other, in which flanges the bolt receptacles are formed and the two bolts are fastened, wherein the fastening flanges are formed by sheets projecting vertically from the shell.

5. Excavator bucket according to claim 4, wherein the fastening flanges comprise a first portion, which is arranged in the region of an opening of the excavator bucket defined by a front edge of the shell and comprise a second portion, which is arranged in the region of a rounded rear wall of the shell, wherein the first bolt is arranged on the first portions and the second bolt is arranged on the second portions of the fastening flanges.

6. Excavator bucket according to claim 5, wherein the fastening flanges in the first portion run substantially parallel to the shell and/or the fastening flanges in the second portion extend in a direction away from the shell and taper.

7. Excavator bucket according to claim 5, wherein the longitudinal of the first bolt and the imaginary connecting line span a first plane and wherein the longitudinal axis of the second bolt and the imaginary connecting line span a second plane, wherein the part of the second plane lying between the imaginary connecting line and the second bolt encloses an acute angle (α) with the part of the first plane that is separated from the first bolt by the imaginary connecting line and runs between the second bolt and the shell, wherein the angle (α) is between 10° and 60°.

8. Excavator bucket according to claim 5, wherein two protective devices for mechanical protection of an energy circuit coupling half of the quick coupling device are arranged on the retaining device or on the shell in the region of the retaining device, wherein the protective devices have a flat protective side facing away from the shell and the protective sides of the two protective devices assume an angle to one another.

9. Implement according to claim 5, wherein the quick coupling device comprises first connecting elements for establishing a first connection optionally to the first or the second bolts of the excavator bucket and further comprises second connecting elements for establishing a second connection to the central bolt receptacles of the excavator bucket, wherein the first connecting elements comprise open bolt receptacles and/or the second connecting elements comprise one or more bolts that can be inserted into the collinear bolt receptacles of the excavator bucket.

10. Method for converting the excavator bucket of an implement according to claim 9 between a backhoe bucket operation and a front loader bucket operation, the method comprising the following steps:

releasing the second connection between the second connecting elements of the quick coupling device and the bolt receptacles of the retaining device;

releasing the first connection between the first connecting elements of the quick coupling device and the first bolt or the second bolt of the retaining device;

rotating the excavator bucket relative to the quick coupling device and/or the quick coupling device relative to the excavator bucket so that subsequently, as viewed from the quick coupling device, the first and second bolts are interchanged;

establishing the first connection between the first connecting elements of the quick coupling device and the second bolt or the first bolt of the retaining device;

establishing the second connection between the second connecting elements of the quick coupling device and the bolt receptacles of the retaining device.

11. Method according to claim 10, wherein the change between backhoe bucket operation and front loader bucket operation is performed without disconnecting or reconnecting the first or second bolt and using the same bolt receptacles.

12. Excavator bucket according to claim 3, wherein the longitudinal axes of the two bolts and an imaginary connecting line extending centrally through the bolt receptacles do not lie in a common plane.

13. Excavator bucket according to claim 3, wherein the two bolts run parallel to each other, wherein the second bolt has a greater distance from the shell than the first bolt.

14. Implement comprising a hydraulic excavator, having an excavator bucket according to claim 1, wherein the implement comprises a boom, on the end of which a quick coupling device is arranged for mounting the excavator bucket.

* * * * *